US007488375B1

(12) United States Patent
Chen

(10) Patent No.: US 7,488,375 B1
(45) Date of Patent: Feb. 10, 2009

(54) FAN COOLING SYSTEM

(75) Inventor: Ting-Kai Chen, Taipei (TW)

(73) Assignee: Inventec Corporation (TW)

( * ) Notice: Subject to any disclaimer, the term of this patent is extended or adjusted under 35 U.S.C. 154(b) by 0 days.

(21) Appl. No.: 11/977,123

(22) Filed: Oct. 23, 2007

(51) Int. Cl.
*B03C 3/68* (2006.01)

(52) U.S. Cl. ..... 96/25; 55/385.6; 96/63; 323/903; 361/226; 361/233; 700/273

(58) Field of Classification Search ..... 96/18, 96/25, 63, 397, 424; 95/2; 55/385.6, 471, 55/473; 700/273; 361/225–235; 323/903
See application file for complete search history.

(56) References Cited

U.S. PATENT DOCUMENTS 4,432,061 A * 2/1984 Herklotz et al. ..... 700/298
4,743,362 A * 5/1988 Pfoh et al. ..... 209/127.4
5,759,239 A * 6/1998 Yu ..... 96/3
6,428,611 B1 * 8/2002 Andolino et al. ..... 96/25
6,540,812 B2 * 4/2003 Farmer et al. ..... 95/2
6,616,736 B2 * 9/2003 Massey et al. ..... 96/25
6,620,222 B2 * 9/2003 White ..... 95/273
6,790,257 B2 * 9/2004 Jeng et al. ..... 95/19
6,974,489 B2 * 12/2005 Behrens et al. ..... 55/385.6
6,989,049 B2 * 1/2006 Belson et al. ..... 96/2
7,199,542 B1 * 4/2007 Chen ..... 318/473
2003/0029319 A1 * 2/2003 Ninomiya et al. ..... 96/63
2004/0123739 A1 * 7/2004 Jan ..... 96/18
2007/0135968 A1 * 6/2007 Bellinger et al. ..... 700/273
2007/0193448 A1 * 8/2007 Tanaka et al. ..... 96/18
2007/0221061 A1 * 9/2007 Steiner et al. ..... 96/63

FOREIGN PATENT DOCUMENTS

JP 53-112579 A * 10/1978 ..... 96/25

* cited by examiner

*Primary Examiner*—Richard L Chiesa
(74) *Attorney, Agent, or Firm*—Peter F. Corless; Steven M. Jensen; Edwards Angell Palmer & Dodge LLP

(57) ABSTRACT

A fan cooling system for use with an electronic apparatus having a fan for providing a cooling draft and adapted to remove draft-borne dust includes: an input module for receiving a control instruction; a programmable logic module electrically connected to the input module and adapted to validate the control instruction received by the input module and output a logic result in accordance with the control instruction; and an electrostatic module comprising an electrostatic filtering unit and an electrostatic controlling unit electrically connected to the electrostatic filtering unit and the programmable logic module, wherein the electrostatic filtering unit adjoins the fan to take the cooling draft, and the electrostatic controlling unit applies static electricity to the electrostatic filtering unit in accordance with the logic result sent from the programmable logic module and thus enables the electrostatic filtering unit to electrostatically adsorb draft-borne dust.

9 Claims, 2 Drawing Sheets

FAN COOLING SYSTEM

BACKGROUND OF THE INVENTION

1. Field of the Invention

The present invention relates to fan cooling systems, and more particularly, to a fan cooling system for use with an electronic apparatus having a fan for providing a cooling draft, so as to electrostatically adsorb draft-borne dust.

2. Description of the Prior Art

With electronic apparatuses becoming lighter, thinner, and shorter, and functioning faster and better, electronic apparatuses are hotter now than they have ever been. A typical way to prevent electronic parts and components of an electronic apparatus from being overheated and damaged is to install a cooling fan in the electronic apparatus to cool the electronic apparatus, or, specifically speaking, introducing cool air into the electronic apparatus, circulate the cool air round the electronic apparatus, thus decreasing internal temperature of the electronic apparatus.

However, introducing cool air into the electronic apparatus inevitably lets in ambient dust. Upon its entry into the electronic apparatus, the dust readily accumulates inside the electronic apparatus because of the limited room inside the miniaturized, crowded electronic apparatus and the sluggish cool air stuck therein. The accumulated dust hinders heat dissipation so badly as to cause a short circuit and render the electronic apparatus short-life.

Accordingly, an issue calling for an urgent solution involves preventing dust from being accumulated inside an electronic apparatus equipped with a cooling fan, so as to overcome drawbacks of the prior art, such as dust-induced inefficiency in heat dissipation and a short life of the cooling fan-equipped electronic apparatus.

SUMMARY OF THE INVENTION

In light of the aforesaid drawbacks of the prior art, it is a primary objective of the present invention to provide a fan cooling system for use with an electronic apparatus having a fan for providing a cooling draft, so as to electrostatically adsorb draft-borne dust, enhance heat dissipation, and thereby overcome drawbacks of the prior art, namely dust accumulation in the electronic apparatus, and a short circuit of electronic parts and components of the electronic apparatus.

In order to achieve the above and other objectives, the present invention discloses a fan cooling system for use with an electronic apparatus having a fan for providing a cooling draft, so as to remove draft-borne dust, comprising: an input module for receiving a control instruction; a programmable logic module electrically connected to the input module and adapted to validate the control instruction received by the input module and output a logic result in accordance with the control instruction; and an electrostatic module comprising an electrostatic filtering unit and an electrostatic controlling unit electrically connected to the electrostatic filtering unit and the programmable logic module, wherein the electrostatic filtering unit adjoins the fan to take the cooling draft, and the electrostatic controlling unit applies static electricity to the electrostatic filtering unit in accordance with the logic result sent from the programmable logic module and thus enables the electrostatic filtering unit to electrostatically adsorb draft-borne dust.

Compared to conventional fan cooling technology, a fan cooling system of the present invention effectively prevents draft-borne dust from intruding into an electronic apparatus.

The fan cooling system of the present invention features the following. An electrostatic filtering unit electrostatically adsorbs draft-borne dust. An input module, coupled with a programmable logic module, enables a user to input a control instruction configured for turning on or off an electrostatic dust removal function and choosing a dust removal level, thus allowing the user to control the intended extent of dust removal and enhance fan cooling.

DETAILED DESCRIPTION OF THE PREFERRED EMBODIMENT

The following specific embodiment is provided to illustrate the present invention. Persons skilled in the art can readily gain insight into other advantages and features of the present invention based on the contents disclosed in this specification.

Figure 1:
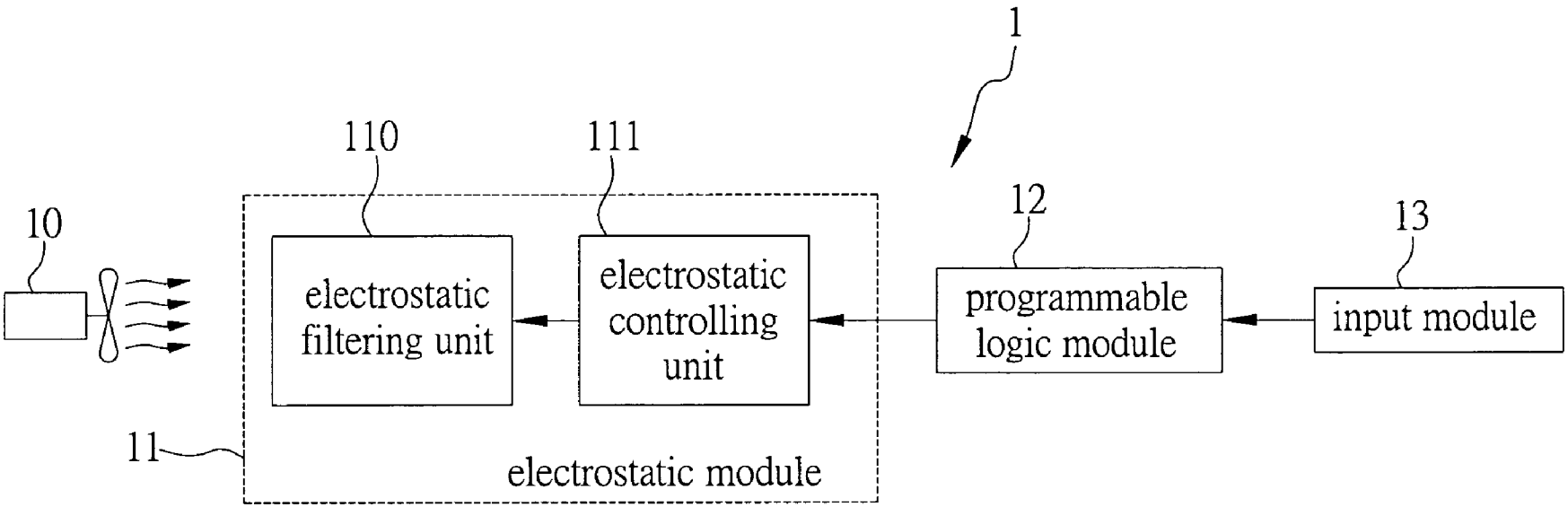
FIG. 1 is a block diagram illustrating a fan cooling system of the present invention.

Referring to FIG. 1, which is a block diagram illustrating a fan cooling system 1 of the present invention, the fan cooling system 1 of the present invention is installed in an electronic apparatus equipped with a fan 10 for heat dissipation. The fan 10 has an inlet and an outlet. Cool air enters the inlet and exits the outlet, before being introduced, in the form of a draft, into the electronic apparatus without carrying any dust.

A preferred embodiment of the fan cooling system 1 comprises an electrostatic module 11, a programmable logic module 12, and an input module 13. The electrostatic module 11 comprises an electrostatic filtering unit 110 and an electrostatic controlling unit 111 electrically connected to the electrostatic filtering unit 110. The electrostatic filtering unit 110 is a mesh, such as a net. The electrostatic filtering unit 110 is disposed at the outlet of the fan 10. The outlet of the fan 10 faces electronic parts and components inside the electronic apparatus. The electrostatic filtering unit 110 blocks draft-borne dust from intruding into the electronic apparatus. The electrostatic controlling unit 111 applies static electricity to the electrostatic filtering unit 110, thus enabling the electrostatic filtering unit 110 to electrostatically adsorb draft-borne dust, and preventing dust from intruding into the electronic apparatus.

The magnitude of static electricity applied to the electrostatic filtering unit 110 by the electrostatic controlling unit 111 depends on a logic result sent from the programmable logic module 12. The programmable logic module 12 generates the logic result in accordance with a control instruction received by the input module 13. Specifically speaking, the input module 13 of the preferred embodiment is, for example, a keyboard, or a key module comprising a plurality of keys, which allows a user to input a control instruction configured for turning on or off an electrostatic dust removal function and choosing a dust removal level (magnitude of static electricity), which are operating options provided by the fan cooling system. The programmable logic module 12, which is a complex programmable logic device (CPLD), is electrically connected to the input module 13 and configured to validate the control instruction received by the input module 13, and then the electrostatic controlling unit 111 performs control instruction-specific processing functions, such as turning on or off the electrostatic dust removal function and adjusting the magnitude of applied static electricity, on the electrostatic filtering unit 110 in accordance with the validated control instruction.

The preferred embodiment of a fan cooling system of the present invention further comprises the following. The electrostatic filtering unit 110 comprises a net enclosing the fan 10 but allowing a draft driven by the fan 10 to pass. Referring to FIG. 1, in addition to the outlet of the fan 10, the electrostatic filtering unit 110 is disposed at the inlet of the fan 10; in other words, the electrostatic filtering unit 110 can be disposed at any positions as appropriate, provided that the electrostatic filtering unit 110 adjoins the fan 10 to take the draft.

Figure 2:
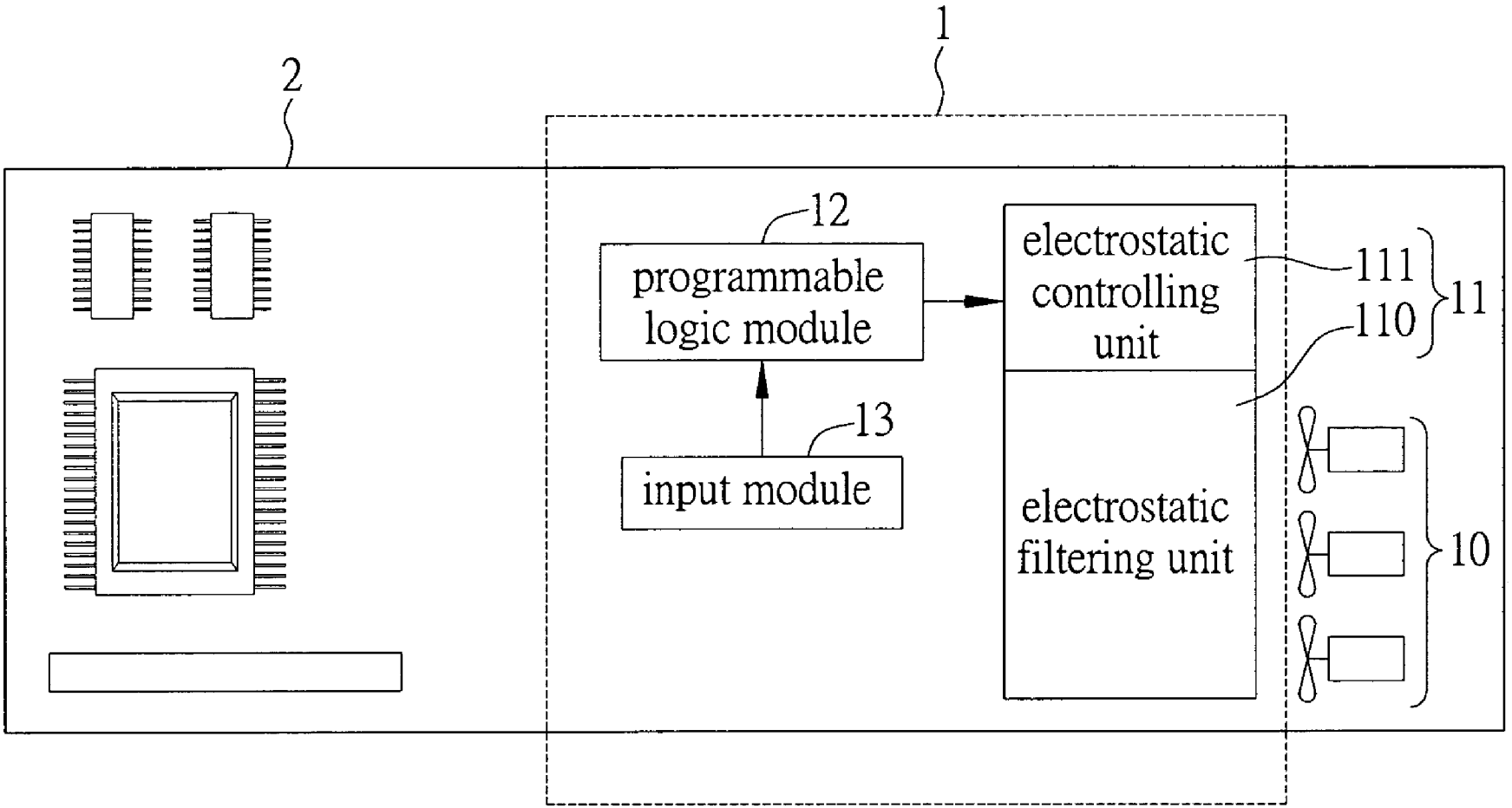
FIG. 2 is a block diagram showing how to apply the fan cooling system of the present invention to an electronic apparatus.

Referring to FIG. 2, which is a block diagram showing how to apply the fan cooling system of the present invention to an electronic apparatus, the fan cooling system 1 of the present invention is installed in an electronic apparatus 2, and the electrostatic filtering unit 110 of the fan cooling system 1 of the present invention is disposed at the outlet of the fan 10. Since the input module 13 allows a user to input a control instruction configured for turning on or off an electrostatic dust removal function and choosing a dust removal level, which are operating options provided by the fan cooling system, the input module 13 is preferably exposed from the casing of the electronic apparatus 2, to facilitate configuration of the dust removal function by the user. Given the electrostatic dust removal function of the fan cooling system of the present invention, cool air enters the inlet of the fan 10 and exits the outlet thereof, before being introduced, in the form of a draft, into the electronic apparatus 2, and thus draft-borne dust is blocked from intruding into the electronic apparatus 2. As a result, the fan cooling system of the present invention overcomes drawbacks of the prior art, namely accumulation of dust in an electronic apparatus, and a short circuit of electronic parts and components of the electronic apparatus.

The aforesaid embodiment merely serves as the preferred embodiment of the present invention. The aforesaid embodiment should not be construed as to limit the scope of the present invention in any way. Hence, many other changes can actually be made in the present invention. It will be apparent to those skilled in the art that all equivalent modifications or changes made to the present invention, without departing from the spirit and the technical concepts disclosed by the present invention, should fall within the scope of the appended claims.

What is claimed is:

1. A fan cooling system for use with an electronic apparatus having a fan for providing a cooling draft, so as to remove draft-borne dust, comprising:

an input module for receiving a control instruction;

a programmable logic module electrically connected to the input module and configured to validate the control instruction received by the input module and output a logic result in accordance with the control instruction; and an electrostatic module comprising an electrostatic filtering unit and an electrostatic controlling unit electrically connected to the electrostatic filtering unit and the programmable logic module, wherein the electrostatic filtering unit adjoins the fan to take the cooling draft, and the electrostatic controlling unit applies static electricity to the electrostatic filtering unit in accordance with the logic result sent from the programmable logic module and thus enables the electrostatic filtering unit to electrostatically adsorb draft-borne dust.

2. The fan cooling system of claim 1, wherein the electrostatic filtering unit is disposed at an outlet of the fan.

3. The fan cooling system of claim 1, wherein the electrostatic filtering unit is disposed at an inlet of the fan.

4. The fan cooling system of claim 1, wherein the electrostatic filtering unit is a mesh.

5. The fan cooling system of claim 4, wherein the electrostatic filtering unit is disposed at an outlet of the fan.

6. The fan cooling system of claim 4, wherein the electrostatic filtering unit is disposed at an inlet of the fan.

7. The fan cooling system of claim 1, wherein the control instruction is configured for one selected from the group consisting of turning on an electrostatic dust removal function, turning off an electrostatic dust removal function, and choosing a dust removal level.

8. The fan cooling system of claim 1, wherein the programmable logic module is a complex programmable logic device (CPLD).

9. The fan cooling system of claim 1, wherein the input module is a keyboard.

* * * * *